US011346627B1

(12) United States Patent
DeMonico

(10) Patent No.: US 11,346,627 B1
(45) Date of Patent: May 31, 2022

(54) FORCED RESET SEMIAUTOMATIC TRIGGER WITH SLIDING BLOCKING BAR

(71) Applicant: ABC IP, LLC, Dover, DE (US)

(72) Inventor: Lawrence DeMonico, Austin, TX (US)

(73) Assignee: ABC IP, LLC, Dover, DE (US)

( * ) Notice: Subject to any disclaimer, the term of this patent is extended or adjusted under 35 U.S.C. 154(b) by 0 days.

(21) Appl. No.: 17/650,310

(22) Filed: Feb. 8, 2022

Related U.S. Application Data

(60) Provisional application No. 63/296,951, filed on Jan. 6, 2022.

(51) Int. Cl.
*F41A 19/10* (2006.01)
*F41A 3/66* (2006.01)
*F41A 19/43* (2006.01)

(52) U.S. Cl.
CPC ..... *F41A 19/10* (2013.01); *F41A 3/66* (2013.01); *F41A 19/43* (2013.01)

(58) Field of Classification Search
CPC ..... F41A 19/10; F41A 19/12; F41A 19/43; F41A 3/66
See application file for complete search history.

(56) References Cited

U.S. PATENT DOCUMENTS 6,101,918 A 8/2000 Akins
6,722,072 B1 4/2004 McCormick
7,162,824 B1 1/2007 McCormick
7,213,359 B2 5/2007 Beretta
7,293,385 B2 11/2007 McCormick
7,398,723 B1 * 7/2008 Blakley ..... F41A 19/10 89/129.01
8,127,658 B1 3/2012 Cottle
8,820,211 B1 9/2014 Hawbaker
9,021,732 B2 5/2015 Johnson
9,146,067 B2 9/2015 Stakes
9,568,264 B2 2/2017 Graves
(Continued)

FOREIGN PATENT DOCUMENTS

TW 409847 U 10/2000

*Primary Examiner* — Joshua T Semick
(74) *Attorney, Agent, or Firm* — Wood Herron & Evans LLP

(57) ABSTRACT

Provided is a trigger mechanism for a firearm having a receiver with a fire control mechanism pocket and a bolt carrier that reciprocates to pivotally displace a hammer when cycled. It includes a hammer having a sear notch and mounted in the fire control mechanism pocket to pivot on a transverse axis between set and released positions. A trigger member has a sear and is mounted in the fire control mechanism pocket to pivot on a transverse axis between set and released positions. The trigger member has a first surface positioned to be forcibly contacted by the hammer when the hammer is displaced by cycling of the bolt carrier, the contact causing at least in part the trigger member to be forced to the set position. A locking bar is slideably mounted in a support frame and spring biased toward a first position in which the locking bar mechanically blocks the trigger member from moving to the released position, and is movable against the spring bias to a second position when contacted by the bolt carrier reaching a substantially in-battery position, allowing the trigger member to be moved by an external force to the released position.

10 Claims, 6 Drawing Sheets

(56) References Cited

U.S. PATENT DOCUMENTS

| | | | | |
|---|---|---|---|---|
| 9,816,772 | B2 | 11/2017 | Graves | |
| 9,939,221 | B2 | 4/2018 | Graves | |
| 10,006,734 | B1 * | 6/2018 | Findlay | F41A 19/12 |
| 10,254,067 | B2 | 4/2019 | Foster | |
| 10,267,584 | B2 * | 4/2019 | Kasanjian-King | F41A 11/00 |
| 10,488,136 | B2 * | 11/2019 | Sullivan | F41A 17/02 |
| 10,502,511 | B2 | 12/2019 | Graves | |
| 10,514,223 | B1 * | 12/2019 | Rounds | F41A 19/12 |
| 10,584,932 | B2 * | 3/2020 | Foster | F41A 17/48 |
| 11,002,500 | B2 | 5/2021 | Graves | |
| 11,287,205 | B2 * | 3/2022 | Biegel | F41A 19/45 |
| 11,293,715 | B1 * | 4/2022 | Newsome | F41A 3/22 |
| 2016/0102933 | A1 | 4/2016 | Graves | |
| 2018/0066911 | A1 | 3/2018 | Graves | |
| 2021/0022974 | A1 | 1/2021 | Kaneko et al. | |

* cited by examiner

FORCED RESET SEMIAUTOMATIC TRIGGER WITH SLIDING BLOCKING BAR

RELATED APPLICATIONS

This application claims priority to U.S. Provisional Patent Application No. 63/296,951, filed Jan. 6, 2022, and incorporates the same herein by reference.

TECHNICAL FIELD

This invention relates to a firearm trigger. In particular, it relates to a forced reset semiautomatic trigger with a sliding locking bar.

BACKGROUND

A forced reset semiautomatic trigger assembly is described in U.S. Pat. No. 10,514,223, issued Dec. 24, 2019, the contents of which are hereby incorporated herein in its entirety by this reference. The locking bar disclosed in the above-referenced patent is spring biased to pivot to a position where it blocks movement of the trigger member until the bolt carrier has returned to a substantially in battery position. An alternative construction may be desired in some situations.

SUMMARY OF THE INVENTION

The present invention provides a trigger mechanism for a firearm having a receiver with a fire control mechanism pocket, transversely aligned pairs of hammer and trigger pin openings in side walls of the pocket, and a bolt carrier that reciprocates and pivotally displaces a hammer when cycled. A hammer has a sear notch and is mounted in the fire control mechanism pocket or a housing to pivot on a transverse hammer pin between set and released positions. A trigger member has a sear and is mounted in the fire control mechanism pocket or housing to pivot on a transverse trigger pin between set and released positions. The trigger member has a first surface positioned to be forcibly contacted by the hammer when the hammer is displaced by cycling of the bolt carrier, the contact causing the trigger member to be forced to the set position. A locking bar is slidably mounted in a frame or housing and is spring biased toward a first position in which the locking bar mechanically blocks the trigger member from moving to the released position. It is movable against the spring bias to a second position when contacted by the bolt carrier reaching a substantially in-battery position, allowing the trigger member to be moved by an external force to the released position.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
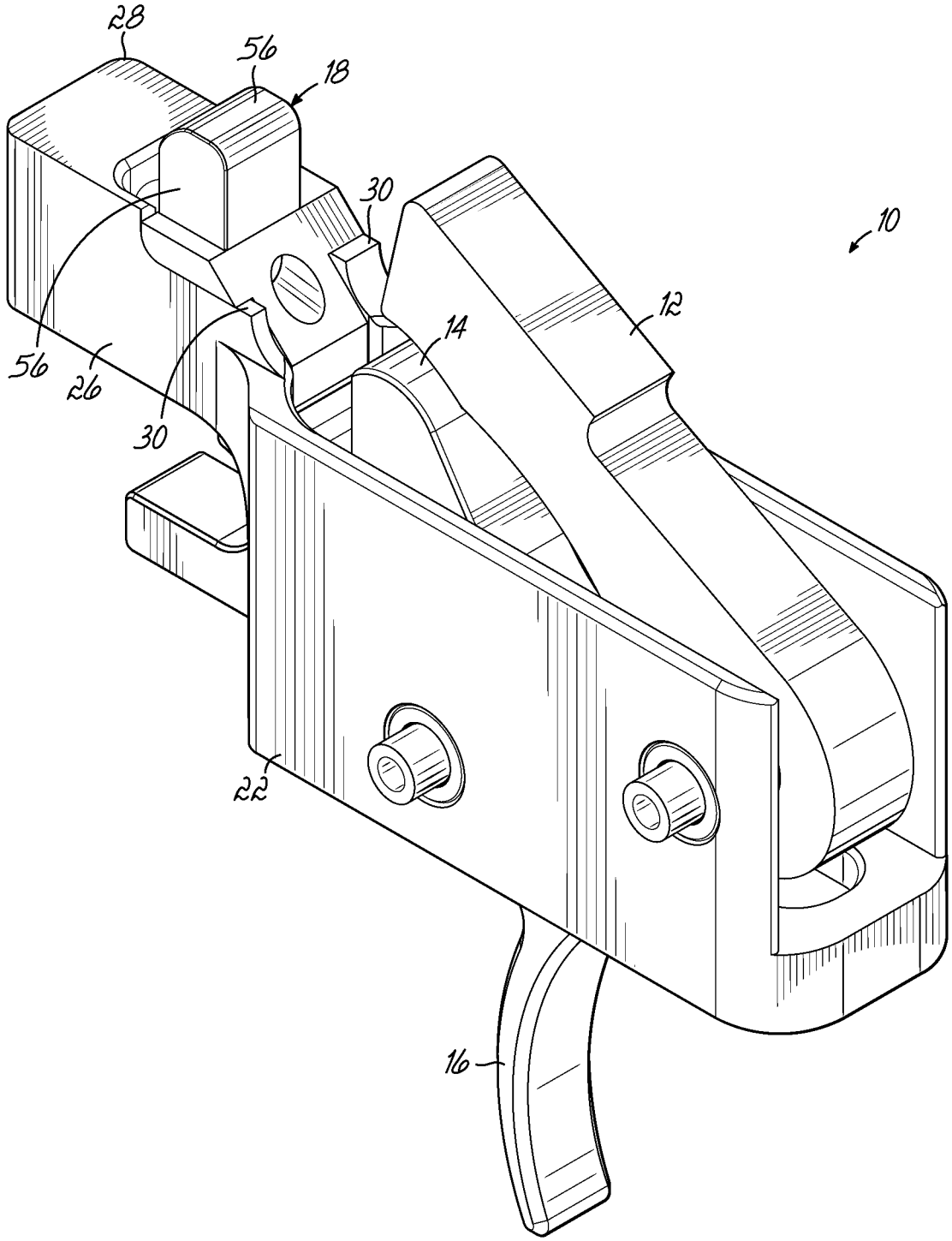
FIG. 1 is a first isometric view of a trigger assembly according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 2:
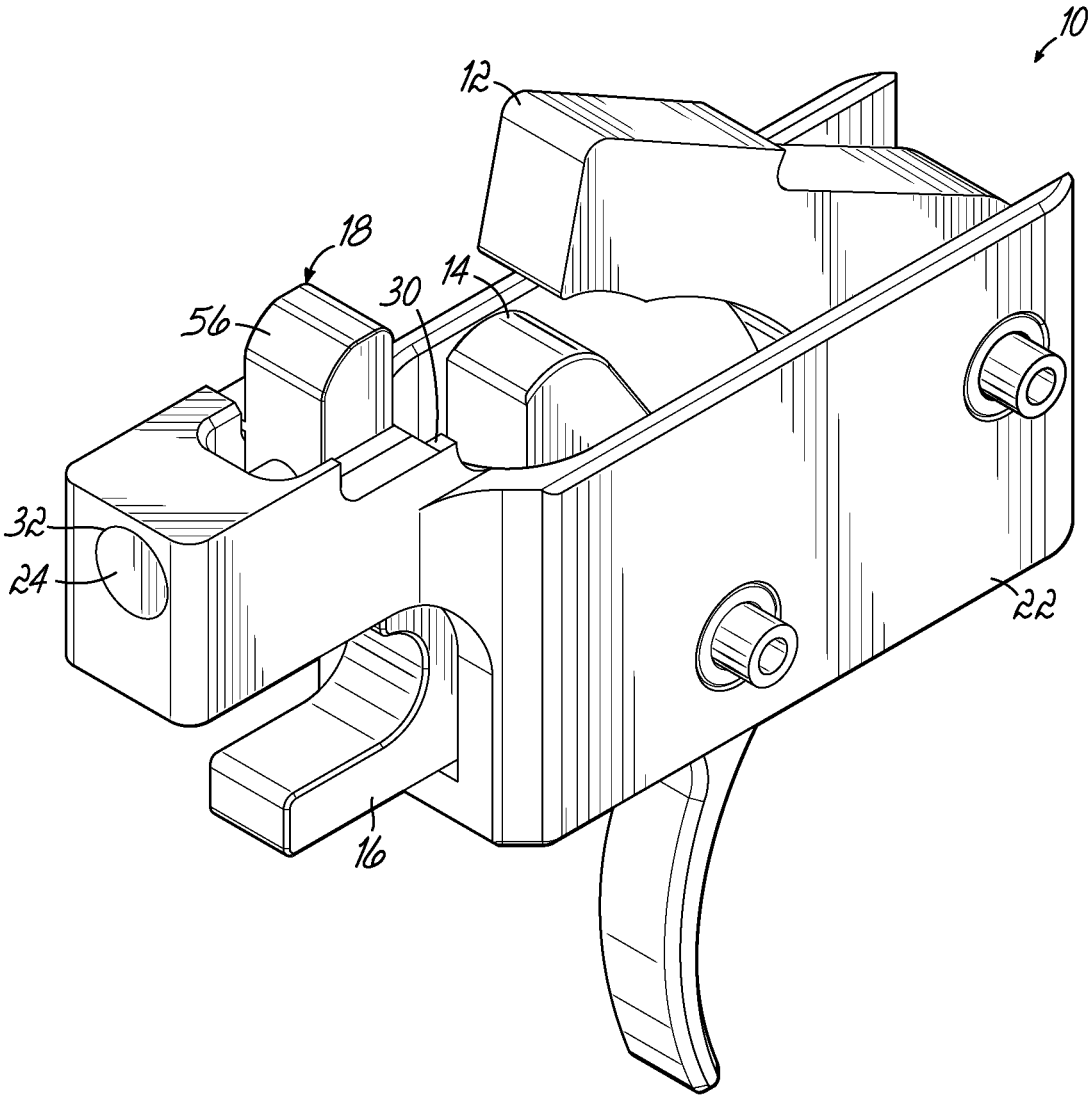
FIG. 2 is a second isometric view thereof.
Figure 3:
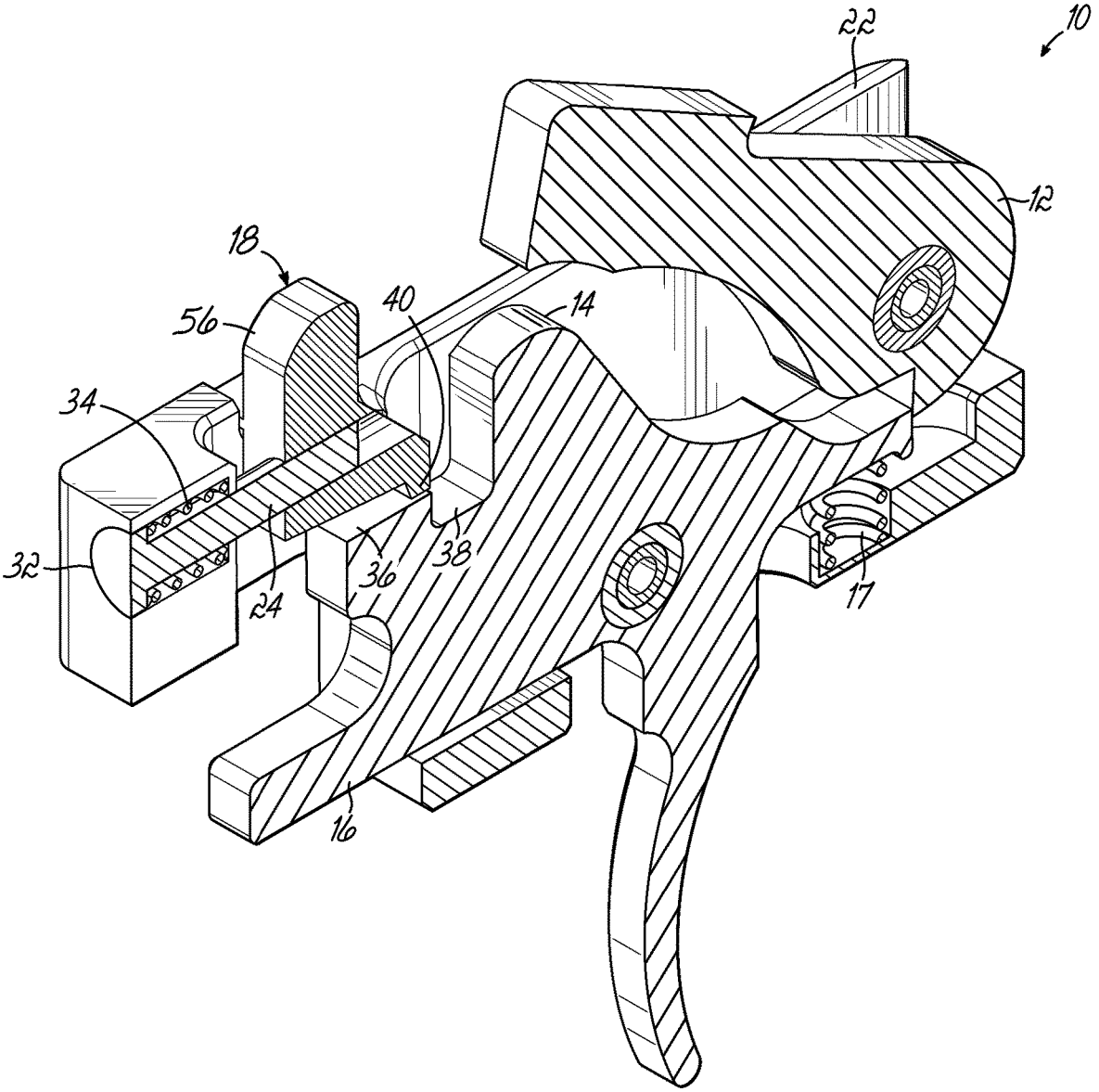
FIG. 3 is a similar isometric view with the housing partially cut-away.
Figure 4:
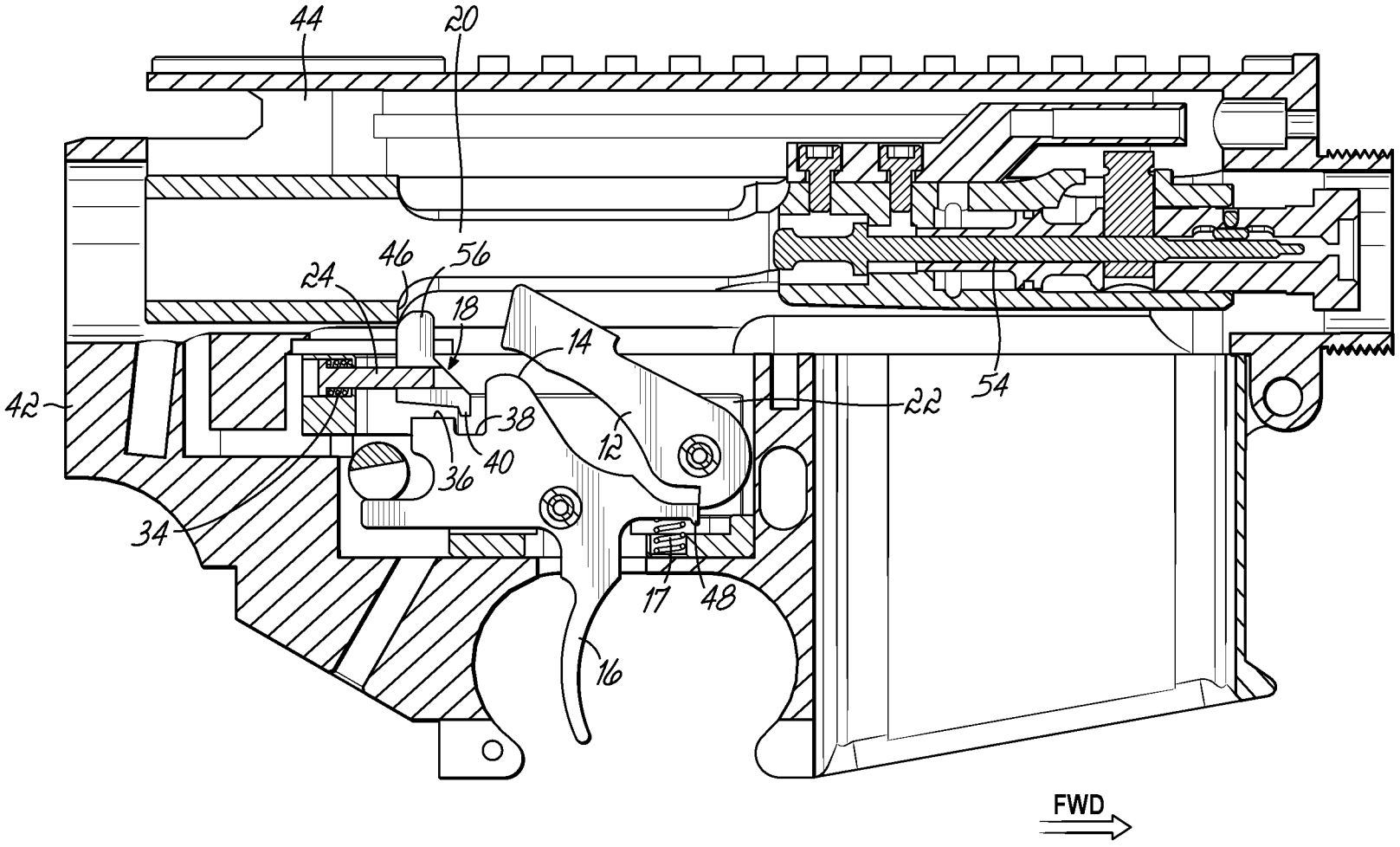
FIG. 4 is a side sectional view with the locking bar in one position.

Referring first to FIGS. 1-3, therein is shown a semiautomatic trigger assembly 10 that operates similar to that described in the aforementioned U.S. Pat. No. 10,514,223 and is adapted for use in an AR15-pattern firearm. Such a trigger is known as a "forced reset" semiautomatic trigger in that, as described in the prior patent, rearward cycling of the bolt carrier 20 (FIGS. 4-6) pivots the hammer 12 into direct or indirect contact with a surface 14 of the trigger member 16 to force the trigger member 16 to its reset position (FIGS. 1-4 and 6). Note that the use of a trigger return spring 17 may contribute to resetting of the trigger member, albeit in a minor way, compared to the force applied by the hammer, without departing from the spirit and scope of the invention. This design does not typically require or include a disconnector. A locking bar 18 locks the trigger member 16 so it cannot be pulled again by the user to fire another shot until the bolt carrier 20 returns to a substantially in-battery position (FIGS. 4 and 6). As used herein, "bolt carrier" may refer to a bolt carrier assembly, bolt carrier body, or an AR-pattern blow-back bolt, as is commonly used in pistol caliber carbine versions of the AR15. It may also be used interchangeably to be inclusive of other reciprocating parts of a firearm action, such as a pistol slide.

The illustrated embodiment is a "drop-in" trigger assembly 10 that includes a housing 22 in which the other parts are assembled, particularly suited for an AR-pattern firearm. The invention may be assembled as separate parts into a frame or receiver (including, but not limited to, an AR-pattern lower receiver) without a housing 22 or into a trigger housing (not shown) that is part of a firearm.

The AR-pattern firearm is enormously popular in the United States due to its modular design and dimensional standardization of many key components and parts. When an AR-pattern firearm is assembled from components made by different manufacturers or a manufacturer with less precise tolerance standards, tolerance stacking in the various parts other than the trigger assembly can sometimes result in imprecise actuation contact between the bolt carrier and the locking bar. In the prior art patent referenced above, the locking bar pivots between two positions on a pivot axis provided by a transverse pivot pin supported by a frame or housing. The present invention changes the motion of the locking bar from pivotal movement to a linear, sliding movement. The invention also allows for adjustable configurations, described in more detail below, which can help compensate for the tolerance stacking effects previously described.

In the illustrated embodiment 10, the sliding locking bar 18 is guided by a guide rod 24 and/or the housing 22 and includes an upward extension that is contacted by the bolt carrier to displace the locking bar 18. More specifically, the locking bar 18 slides between side walls 26 of a rearward extension 28 of the housing 22 and/or top surfaces 30 of the housing 22. This prevents both rotation and tipping of the locking bar 18 as it moves longitudinally. It is further guided by the guide rod 24 that reciprocates in a channel 32 in the housing 22 and includes a biasing spring 34 to return the locking bar 18 to the locking position.

In alternate embodiments not shown, guiding support for the locking bar 18 can include multiple guide rods positioned side-by-side or in an under/over configuration. Or a guide rod may be non-round to prevent rotation (and tipping) of the locking bar. Likewise, the housing could include longitudinal channels or ribs that slidingly mate with ribs or channels on the locking bar. The biasing spring may take various forms or positions, including using an extension spring (rather than a compression spring, as shown) or positioning the spring forward of the locking bar.

In the illustrated embodiment, the trigger member 16 includes a second surface 36 and/or recess surface 38 positioned to engage with the locking bar when the bolt carrier is out of battery (FIG. 6). The locking bar may include a foot extension 40 shaped to engage/disengage with the surface 36 of the trigger member 16.

Referring now to FIG. 4, therein is shown a trigger assembly 10 installed in an AR-pattern lower receiver 42. The bolt carrier 20 longitudinally reciprocates in the upper receiver 44 when the action cycles. When the bolt carrier 20 is in in the substantially in-battery position, as shown, a contact surface 46 of the bolt carrier 20 contacts and pushes the locking bar 18 forward against the bias of the locking bar spring 34. In this position, the foot extension 40 of the locking bar 18 is aligned with the recess 38 of the trigger member 16, allowing the trigger member 16 to be pivoted by force of the user's finger from this set position to a fired position. The trigger member spring 17 provides resistance and largely determines the force required to "break" engagement of the sear 48 with the hammer 12.

Figure 5:
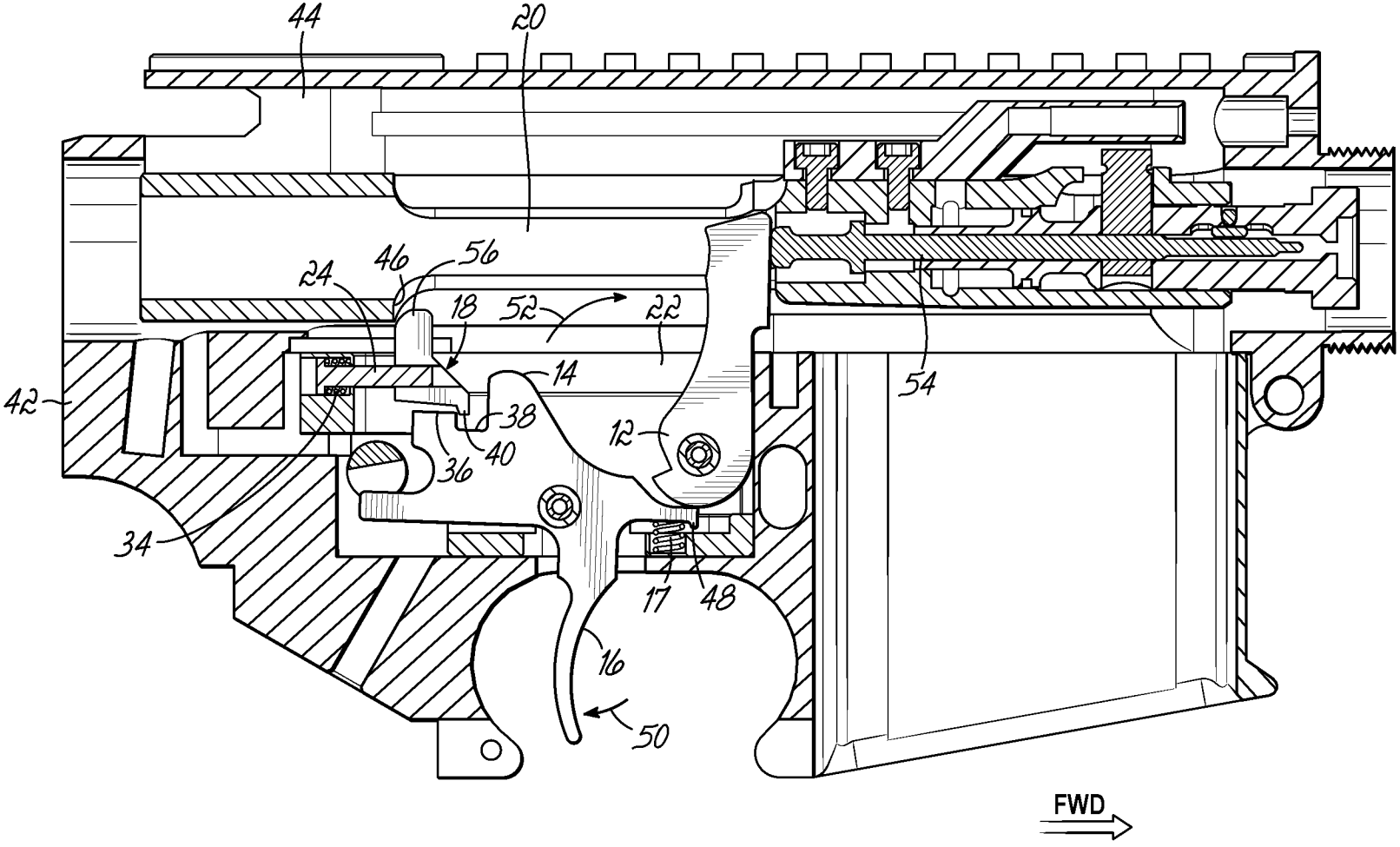
FIG. 5 is a similar side sectional view with the locking bar in the same position and the trigger pulled to release the hammer.
Figure 6:
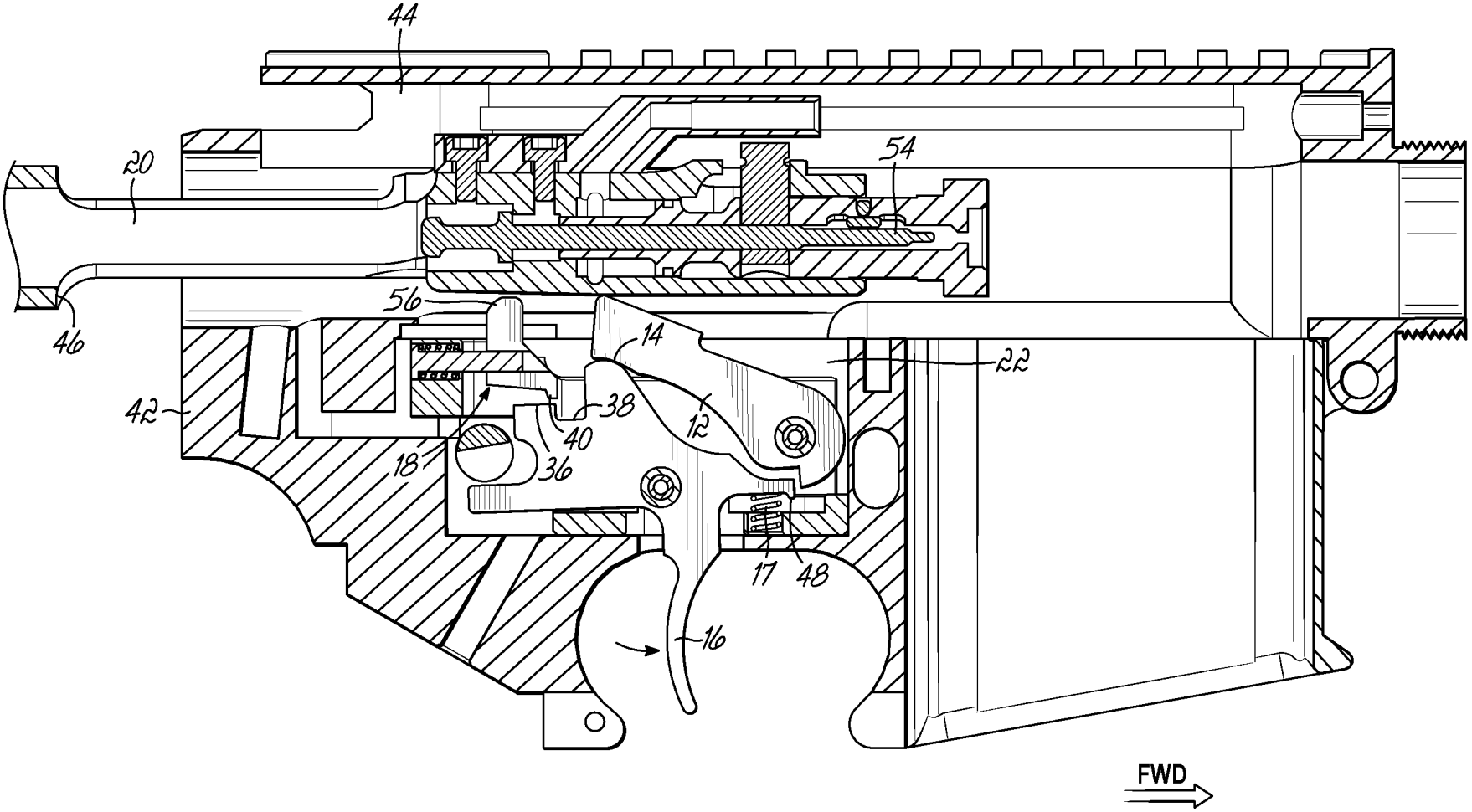
FIG. 6 is a similar side sectional view with the locking bar in another position blocking movement of the trigger, after the hammer has reset the trigger member and before the bolt carrier has returned to the in-battery position to move the locking bar back to the prior position.

Referring to FIG. 5, when the trigger member 16 is pulled by the user (arrow 50), the hammer 12 is released and pivots (arrow 52) by spring force (not shown) to strike the firing pin 54.

Referring to FIG. 6, the bolt carrier 20 is cycled rearward (either directly or indirectly by gas pressure) and forces the hammer 12 to pivot back toward the set position. The hammer 12 directly or indirectly contacts the trigger member surface 14 and forces the trigger member 16 to the reset position where the sear 48 engages and holds the hammer 12. When the bolt carrier 20 cycles to the rear, its contact with the locking bar 18 is released, allowing the locking bar 18 to slide by spring bias to the rear and locks the trigger member 16, preventing it from being pulled so long as the bolt carrier 20 is out of battery.

The sliding action of the locking bar 18 allows for adjustability adaptation in various way not available with the prior art pivoting member. For example, the guide rod 24 in the illustrated embodiment could engage the locking bar 18 with threads so that the longitudinal position is adjustable by rotating the rod 24 (which may include a tool socket or protrusion for rotating adjustment). Or the position of the locking bar 18 on the rod 24 could be fixed by a set screw or other adjustment pin. The upward extension portion 56 could be a separate piece that is adjustably positioned relative to the base of the locking bar 18. Or the position of the locking contact surface (foot extension 40) may be adjustable.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. For a firearm having a receiver with a fire control mechanism pocket and a bolt carrier that reciprocates to pivotally displace a hammer when cycled, a trigger mechanism, comprising:

a hammer having a sear notch and mounted in the fire control mechanism pocket to pivot on a transverse axis between set and released positions;

a trigger member having a sear and mounted in the fire control mechanism pocket to pivot on a transverse axis between set and released positions, the trigger member having a first surface positioned to be forcibly contacted by the hammer when the hammer is displaced by cycling of the bolt carrier, the contact causing at least in part the trigger member to be forced to the set position; and a locking bar slideably mounted in a support frame and spring biased toward a first position in which the locking bar mechanically blocks the trigger member from moving to the released position, and movable against the spring bias to a second position when contacted by the bolt carrier reaching a substantially in-battery position, allowing the trigger member to be moved by an external force to the released position.

2. The trigger mechanism of claim 1, further comprising a trigger member reset spring.

3. The trigger mechanism of claim 1, wherein the receiver pocket has transversely aligned pairs of hammer and trigger pin openings in side walls of the pocket.

4. The trigger mechanism of claim 1, wherein the hammer transvers axis is provided by a hammer pivot pin.

5. The trigger mechanism of claim 1, wherein the trigger transverse axis is provided by a transverse trigger pin.

6. For a firearm having a receiver with a fire control mechanism pocket and a bolt carrier that reciprocates to pivotally displace a hammer when cycled, a trigger mechanism, comprising:

a housing;

a hammer having a sear notch and mounted in the housing to pivot on a transverse axis between set and released positions;

a trigger member having a sear and mounted in the housing to pivot on a transverse axis between set and released positions, the trigger member having a first surface positioned to be forcibly contacted by the hammer when the hammer is displaced by the bolt carrier when cycled, the contact causing at least in part the trigger member to be forced to the set position;

a locking bar slidably mounted in the housing and spring biased toward a first position in which the locking bar mechanically blocks the trigger member from moving to the released position, and movable against the spring bias to a second position when contacted by the bolt carrier reaching a substantially in-battery position in which the trigger member can be moved by an external force to the released position.

7. The trigger mechanism of claim 6, further comprising a trigger member reset spring.

8. The trigger mechanism of claim 6, wherein the receiver pocket has transversely aligned pairs of hammer and trigger pin openings in side walls of the pocket and the housing includes transversely aligned pairs of openings for receiving hammer and trigger assembly pins.

9. The trigger mechanism of claim 6, wherein the hammer transvers axis is provided by a hammer pivot pin.

10. The trigger mechanism of claim 6, wherein the trigger transverse axis is provided by a transverse trigger pin.

* * * * *